United States Patent [19]

Hartmann

[11] Patent Number: 4,621,555

[45] Date of Patent: Nov. 11, 1986

[54] APPARATUS FOR CUTTING A POROUS CONCRETE BLOCK WHICH IS STILL IN A PLASTIC CONDITION

[75] Inventor: Wilfried Hartmann, Emmering, Fed. Rep. of Germany

[73] Assignee: Hebel GmbH Holding, Emmering, Fed. Rep. of Germany

[21] Appl. No.: 774,509

[22] Filed: Sep. 10, 1985

[30] Foreign Application Priority Data

Sep. 20, 1984 [DE] Fed. Rep. of Germany ..... 3434505

[51] Int. Cl.[4] ..... B26D 5/00; B26D 1/18

[52] U.S. Cl. ..... 83/620; 83/651.1; 83/700

[58] Field of Search ..... 83/651.1, 620, 461.1, 83/700; 425/289, 308, 316

[56] References Cited

U.S. PATENT DOCUMENTS

| | | | |
|---|---|---|---|
| 273,176 | 2/1883 | Smith | 83/651.1 |
| 3,142,905 | 8/1964 | Strasbaugh | 83/700 |
| 3,204,315 | 9/1965 | Akerfors | 83/651.1 |
| 3,805,655 | 4/1974 | Vrijma | 83/651.1 |
| 4,326,439 | 3/1980 | Frost et al. | 83/651.1 |
| 4,436,501 | 3/1984 | Kenworthy | 425/308 |

*Primary Examiner*—Willard E. Hoag

*Attorney, Agent, or Firm*—Flynn, Thiel, Boutell & Tanis

[57] ABSTRACT

In the cutting apparatus for cutting a porous concrete block which is still in a plastic condition, the cutting table comprises a plurality of bars (5) which are disposed parallel and at a spacing from each other. The bars (5) are mounted horizontally displaceably perpendicularly to their longitudinal direction while provided between the bars (5) are spacer members (20) which restrict the movement of the bars relative to each other when they are pulled apart and pushed together, to the width of the cutting gap, such that the mutual spacing (S) of the bars (5) which are drawn apart prior to the cutting operation can be reduced by the width of the cutting gap after the cutting operation, by pushing the bars towards each other. Each bar (5) is divided in its longitudinal direction along a vertical plane (V) and comprises two bar halves (5*a*, 5*b*) which are adjustable horizontally relative to each other perpendicularly to the longitudinal direction and the mutual spacing (a1) of which is adjustable by means of a respective adjusting device (8) engaging each of the oppositely disposed ends of the bar halves (5*a*, 5*b*). Also provided at each adjusting device (8) is a coupling means which permits the two bar halves (5*a*, 5*b*) which together make up a respective bar (5) to be completely released.

7 Claims, 9 Drawing Figures

Figure 1:
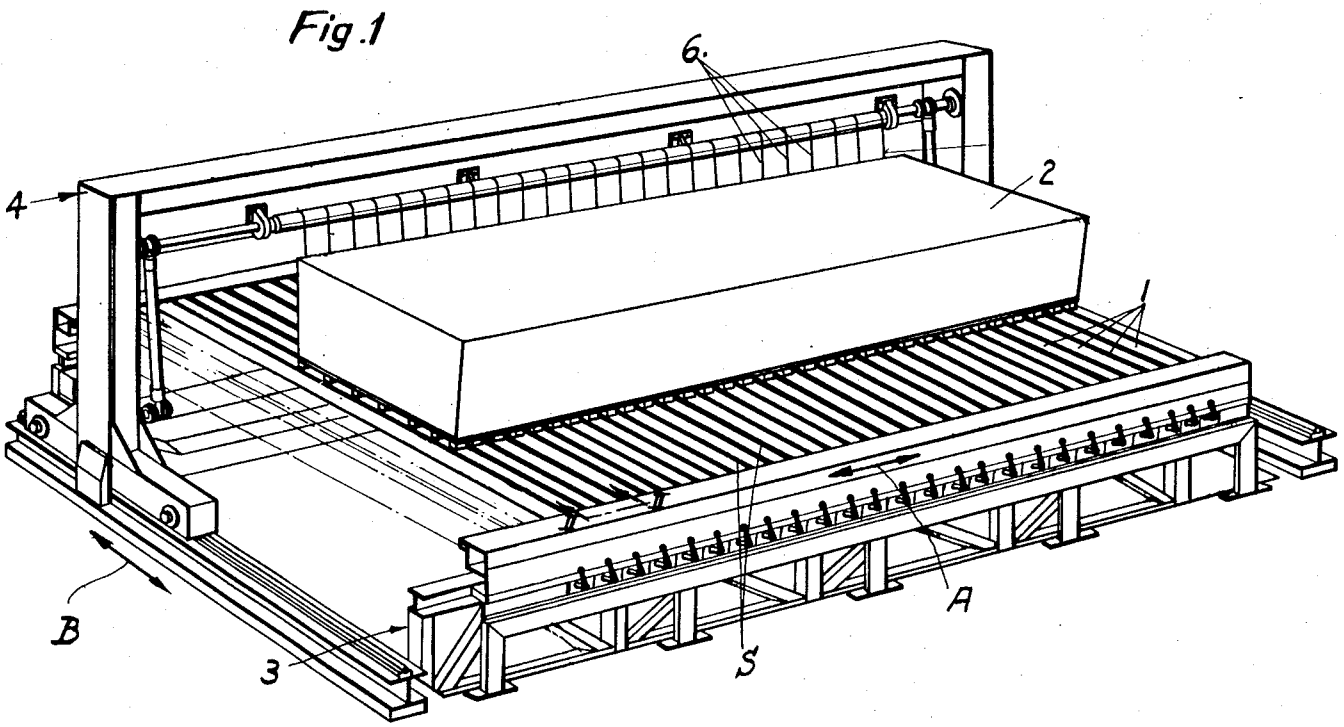

III
5
A
6
7
V
b
S
d
a1
5a
5b
19
18
IV
25
14
21a
22
20
21
S1
9
8
16

18
10b
9
5a
22
14
21
11b
16

APPARATUS FOR CUTTING A POROUS CONCRETE BLOCK WHICH IS STILL IN A PLASTIC CONDITION

The invention relates to an apparatus for cutting a porous concrete block which is still in a plastic condition, having a horizontal cutting table comprising a plurality of bars which are arranged parallel and at a spacing from each other, for receiving the square porous block which is lying on its wide side, and having a cutting frame which is movable relative to the cutting table in the longitudinal direction of the bars, with a plurality of cutting wires which extend in vertical planes and which are passed through the slots between the bars and by means of which the block can be cut up in a first horizontally extending direction of cut, wherein the bars are mounted horizontally displaceably perpendicularly to their longitudinal direction and disposed between the bars are spacer members which restrict the relative movement of the bars away from and towards each other, to the width of the cutting gap, in such a way that the mutually spacing of the bars which are drawn apart from each other prior to the cutting operation can be reduced, after the cutting operation in the first direction of cut, by pushing the bars together, by the width of the cutting gap.

By virtue of the porous concrete block which is cut in a first direction of cut, preferably in the transverse direction, being pushed together, in a known cutting apparatus of the above-indicated kind (German patent specification No. 2 428 115), that arrangement seeks to provide that the cutting gap which is left behind by the cutting wires is closed again and the cut portions of the block are brought to bear against each other. When the block is cut in a second direction which is normal to the first direction of cut, the fact that the portions of block are brought together again in the above-indicated manner is intended to prevent the cut slabs or bricks from crumbling away. As the previously known cutting apparatus is intended to cut bricks which are 24 or 25 cm in width and also slabs of any length, two additional and independently operative adjusting means in the form of piston-cylinder units are provided between the individual bars at respective ends thereof. One piston-cylinder unit has a stroke length of 1 centimeter while the other piston-cylinder unit has a greater stroke length which can be controlled by pushbuttons. By means of the first piston-cylinder unit, it is possible for the slot between two adjacent bars to be additionally increased by ne centimeter so that bricks of a 25 cm format can be cut. However, the comparatively large slot width suffers from the disadvantage that the porous concrete block is no longer supported in the vicinity of the cutting wire and can already suffer from crumbling when it is cut in the first direction of cut. If, for cutting slabs, the width of the slot between two adjacent bars is further increased by actuating the second piston-cylinder units, then crumbling can occur to an increased degree.

The invention is therefore based on the problem of providing an apparatus for cutting a porous concrete block which is still in a plastic condition, of the kind set forth in the opening part of this specification, wherein the width of the slot between two bars can be minimised when cutting all formats, in a fashion which is of the utmost simplicity, in order thereby to provide optimum support for the porous concrete block in the region of cutting thereof and to prevent crumbling. According to the invention, that is achieved in that each bar is divided in its longitudinal direction along a vertical plane and comprises two bar halves which are horizontally adjustable relative to each other perpendicularly to the longitudinal direction and the mutual spacing of which can be adjusted by means of a respective adjusting device engaging each of the oppositely disposed ends of the bar halves, further that provided at each adjusting device is a coupling means which permits the two bar halves respectively belonging to a bar to be completely released, and that provided at one of the two bar halves is a clamping means with which said bar half can be fixedly clamped to a clamping bar member at any point thereon, said clamping bar member extending in the direction of displacement of the bars and being connected to the main frame structure.

In the novel cutting apparatus, the slot between two bars between which a cutting wire is moved can be kept at the optimum small size when cutting any formats, irrespective of whether bricks which are for example 24 or 25 cm in width or slabs of any desired length are to be cut. Two adjacent bars are always connected together by the spacer members provided at the ends thereof, irrespective of what format is to be cut, more specifically the bars being connected together in such a way that the width of the slot between two adjacent bars in the cutting position is desirably only slightly wider than the diameter of the cutting wire. When cutting the smallest format, the two bar halves of each bar can be brought closely together by means of the adjusting device. For cutting a brick format which is for example larger by 1 centimeter, the two halves of each bar are moved apart by one centimeter by means of the adjusting devices so that a gap which is larger by 1 centimeter is formed between the contact surfaces of the halves of the bar, whereby the support width afforded by each bar is increased. The gap between the two halves of the bar does not play any part for no cutting is effected at that location. By virtue of the movement of the halves of the bar away from each other, by means of the adjusting device, the width of the slot between the bars which each comprise two halves remains unaltered so that optimum support for the porous concrete block is provided at that point in the cutting operation. For the purposes of transversely cutting slabs of greater length, two bar halves can be completely released from each other in the vicinity of the intended line of cut, by releasing the coupling means. Each of those two bar halves however remains connected to the adjacent bars by way of the spacer members. One of the two bar halves, together with the other bars connected thereto, can now be shifted until the slot between the bar half and the adjacent bar comes to lie in the region of the intended line of cut. By actuating the clamping means, one bar of the displaced array of bars is clamped fast, and cutting can then be carried out at the required location. In this case also the width of the slot is of the same size as when cutting the two smaller formats.

Further advantageous embodiments of the invention are characterised in the subsidiary claims.

Figure 2:
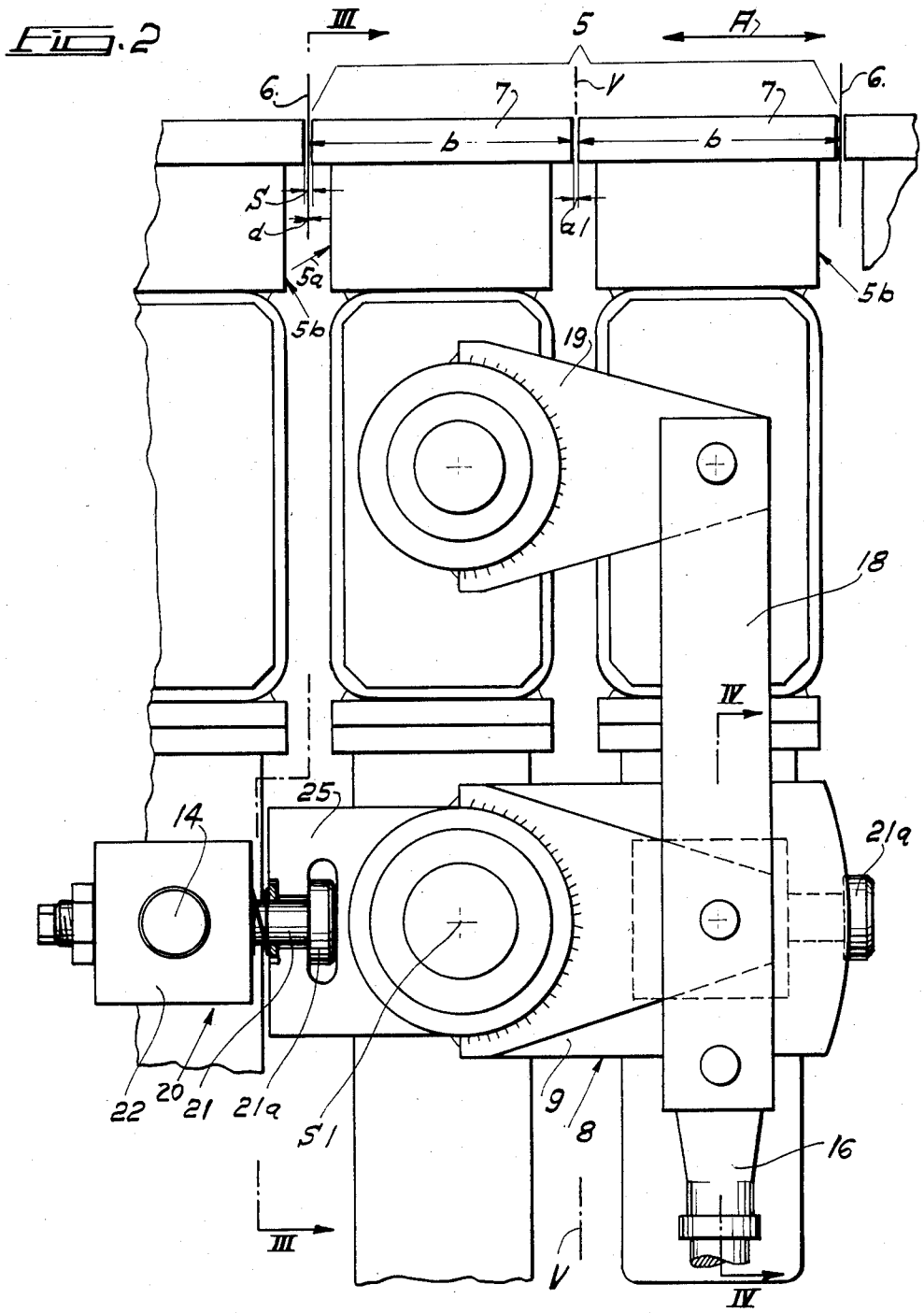
Figure 2A:
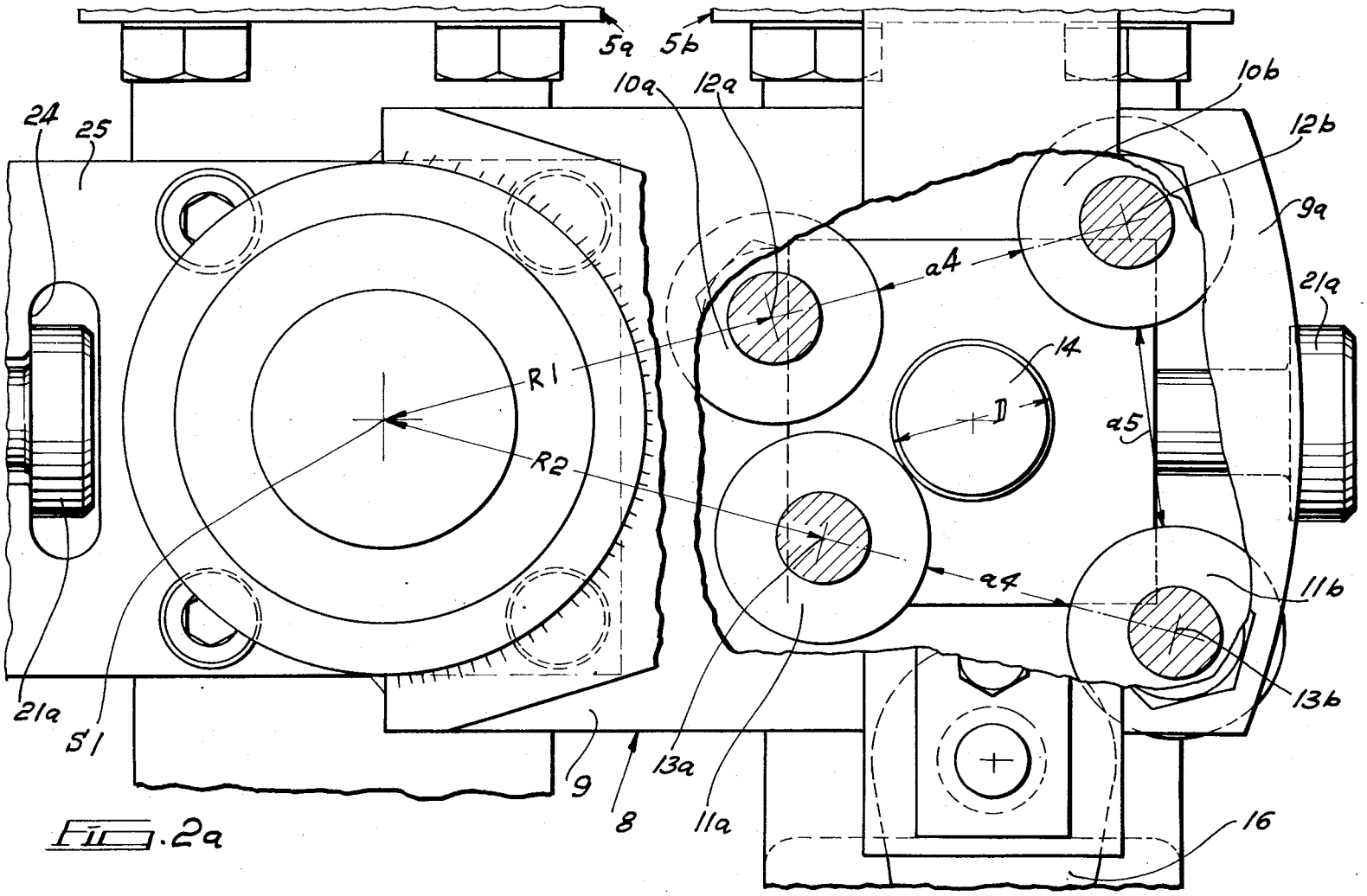
Figure 2B:
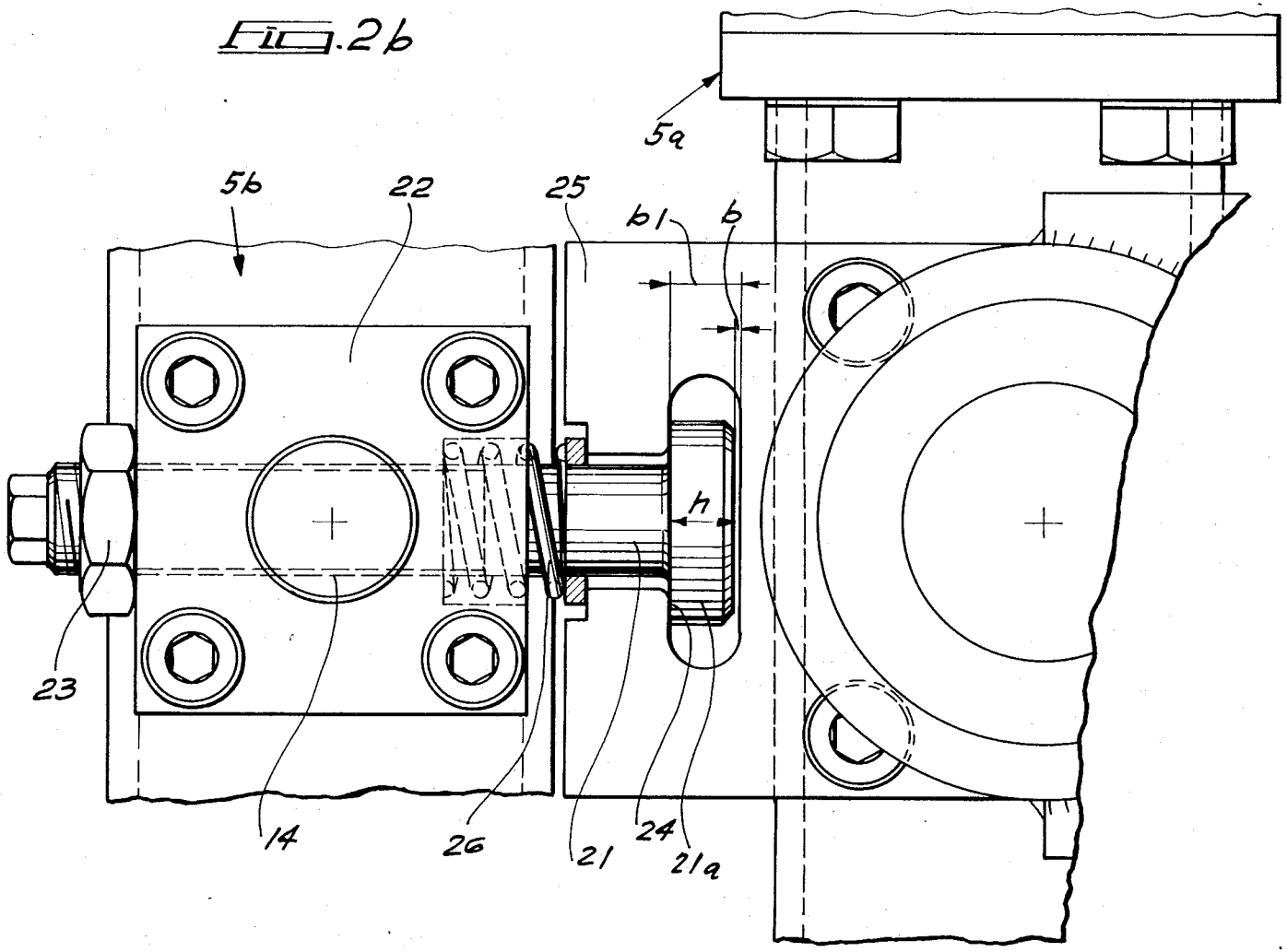
Figure 3:
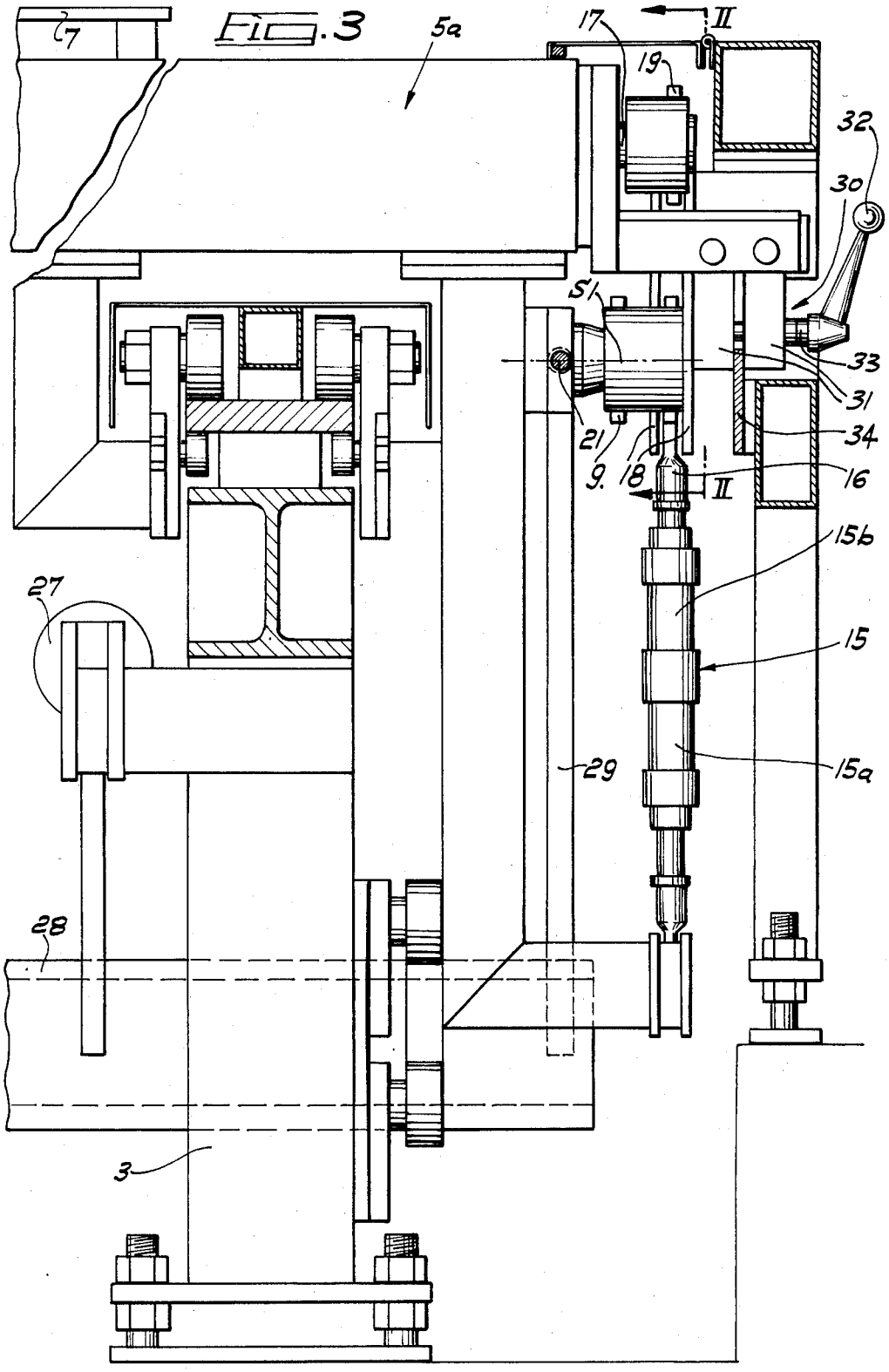
Figure 4:
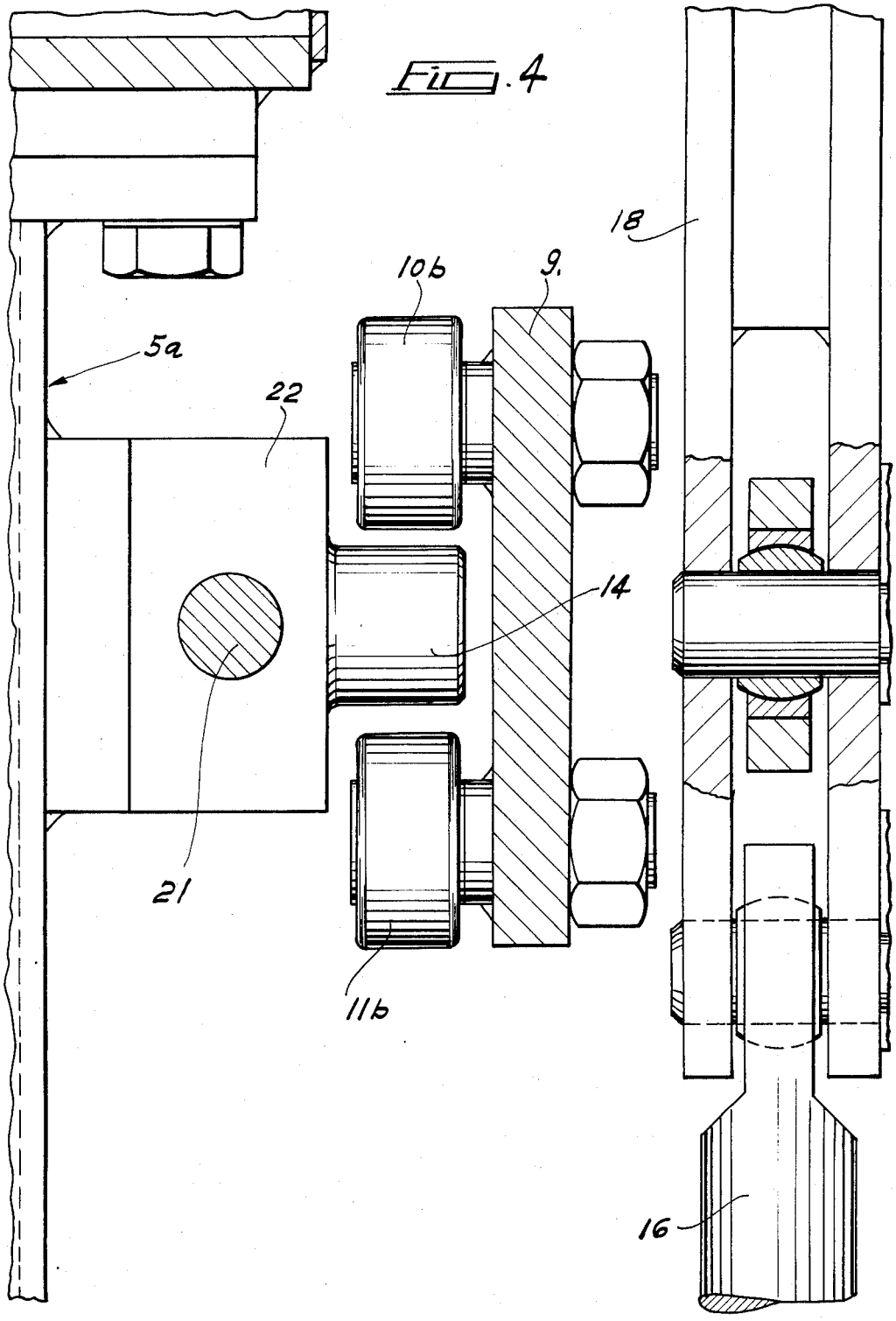
Figure 5:
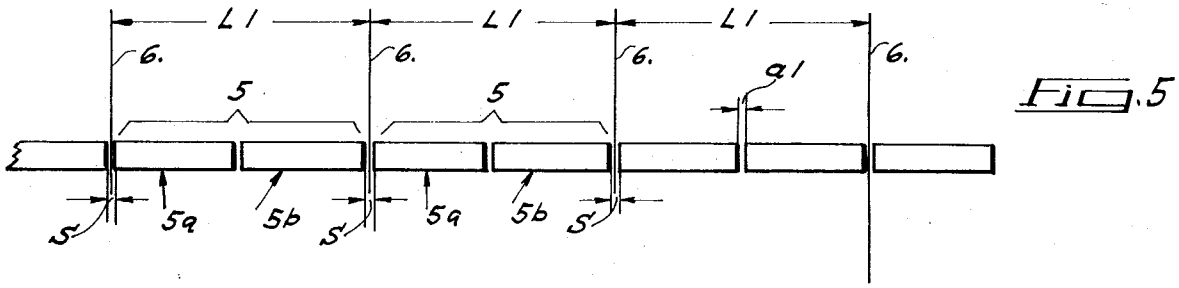
Figure 6:
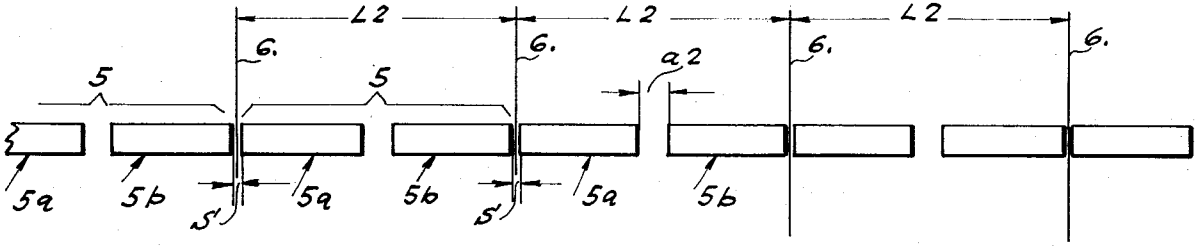
Figure 7:
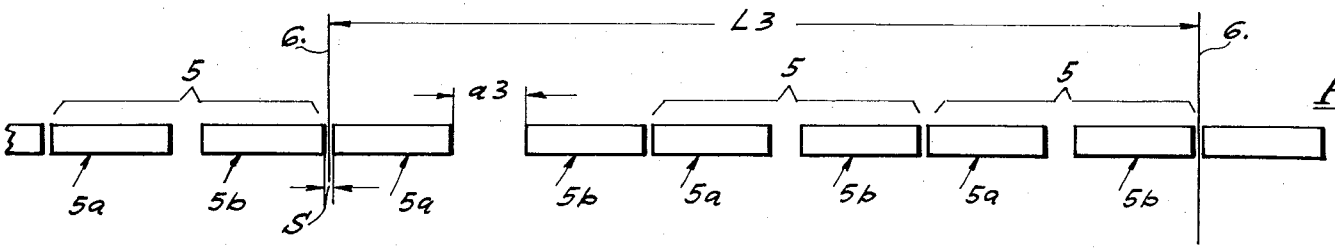

The invention is described in greater detail hereinafter by reference to an embodiment illustrated in the drawings in which:

FIG. 1 is a perspective view of the cutting apparatus,

FIG. 2 is a view of part of the apparatus in section taken along line II—II in FIG. 1 or FIG. 3, FIG. 2*a* shows details of the adjusting device provided between two bar halves, on a 1:1 scale, FIG. 2*b* shows details of the spacer members provided between two bars, on a 1:1 scale, FIG. 3 shows part of the apparatus in cross-section taken along line III—III in FIG. 2, FIG. 4 shows a part of the apparatus in cross-section taken along line IV—IV in FIG. 2, FIG. 5 shows the position of the bar halves when cutting a small brick format, FIG. 6 shows the position of the bar halves when cutting a somewhat larger format, and FIG. 7 shows the position of the bar halves when cutting slabs.

Referring to the drawing, reference numeral 1 generally denotes a cutting table which serves to carry a parallelepiped porous concrete block 2 which is disposed on its wide side. The cutting table 1 comprises a plurality of bars, the construction of which can be seen in particular from FIGS. 2 and 3. As will be described in greater detail hereinafter, the bars 5 are mounted on the main frame structure 3 displaceably individually and jointly perpendicularly to their longitudinal direction, in the direction indicated by the arrow A. The arrangement also includes a cutting frame 4 which can be displaced in the longitudinal direction of the bars 5, in the direction indicated by B. The cutting frame 4 has a plurality of cutting wires 6 which can be fitted therein and which are reciprocated in their longitudinal direction in known fashion during the cutting operation in order to give cut surfaces which are smooth as possible. The cutting wires 6 are passed through slots S between the bars. The cutting wires 6 permit the concrete block 2 to be cut up in a first horizontally extending direction of cut. The block is then taken off the cutting table 1 and taken to a further cutting apparatus (not shown). That cutting apparatus has cutting wires for cutting the porous concrete block 2 in a further direction of cut which is perpendicular to the first and which is also horizontal.

As can be seen in particular from FIG. 2 but also from FIGS. 5 to 7, each bar 5 comprises two bar halves 5*a* and 5*b* which are arranged on both sides of a vertical plane V—V passing through the middle of the bar 5. Disposed on each bar half 5*a* and 5*b* is a support plate 7 whose width b is somewhat smaller than half the length L1 of the smallest brick format to be cut.

The relative spacing a1 and a2 respectively of the two halves 5*a*, 5*b* forming a respective bar 5 can be adjusted by means of respective adjusting devices 8 which engage the two oppositely disposed ends of the bar halves 5*a* and 5*b*. Also provided is a coupling means which permits the two bar halves 5*a* and 5*b* which go to make up a respective bar 5 to be completely released. In the advantageous embodiment illustrated, the coupling means is integrated in the adjusting device.

FIG. 2*a* shows further details of the adjusting device 8. The adjusting device 8 comprises a pivotable arm 9 which is pivotable on the first bar half 5*a* about a pivot axis S1 extending in the longitudinal direction thereof. The arm 9 carries two pairs of rollers 10*a*, 10*b* and 11*a*, 11*b* which are arranged at a spacing one above the other. The axes of rotation 12*a*, 12*b*, and 13*a*, 13*b* thereof respectively extend parallel to the pivot axis S1. The axis 12*a* of the radially inward roller 10*a* of the pair 10*a* and 10*b* is disposed at a smaller spacing R1 from the pivot axis S1 while the axis 13*a* of the inner roller 11*a* of the second pair 11*a* and 11*b* is disposed at a larger spacing R2 from the pivot axis S1. The difference between the spacings R1 and R2 is about 10 millimeters, more precisely 9.375 mm. Provided on the second bar half 5*b* is a cylindrical projection 14 which extends into the region of movement of the rollers 10*a*, 10*b*, and 11*a*, 11*b*, and the diameter D of which corresponds to the spacing a4 between the two rollers 10*a*, 10*b* and 11*a*, 11*b* which form the respective pairs of rollers. In addition, the spacing a5 between the two rollers 10*b* and 11*b* which are disposed at the free end of the arm 9 is larger than the diameter D of the projection 14.

A hydraulic piston-cylinder unit 15 is provided for actuating the arm 9. That permits the actuating rod 16 to be moved into two predetermined limit positions and a predetermined middle position. In practice, the hydraulic piston-cylinder unit comprises two cylinders 15*a* and 15*b* which are arranged in coaxial relationship with each other and in each of which respective double-acting pistons are displaceable. The cylinder chambers belonging to each cylinder 15*a* and 15*b* can be seprately supplied with pressure oil. A piston-cylinder unit of that kind is also referred to as a '3-position hydraulic cylinder'.

For the purposes of adjusting the mutual spacing a1 and a2 of the two bar halves 5*a* and 5*b*, adjusting devices 8 of the same kind are provided at both ends of the bar halves. In order to ensure simultaneous adjustment at both ends, it is desirable for the pivotable movement of the arm 9 provided at one end of the bar half 5*a* to be transmitted by way of a pivot shaft 17 which extends parallel to that bar half 5*a*, to the arm 9 of the adjusting device 8 which is disposed at the other end of the bar half. The arm 9 is connected by way of connecting bars 18 to the arm 19 which in turn is non-rotatably connected to the shaft 17. Each bar which consists of two bar halves 5*a* and 5*b* has such an adjusting device 8 at both ends. The hydraulic piston-cylinder units 15 can be actuated both individually and also jointly.

In addition, disposed between two bars 5, also at the ends of the bars and in the region of the adjusting devices 8, is a respective spacer member 20 which is shown in greater detail in FIG. 2*b*. The spacer members are intended always to couple two adjacent bars 5 to each other, but the relative movement of the bars in the direction of displacement A is to be restricted to the width of the cut produced in the porous concrete block 2 by the cutting wires 6.

Each spacer member 20 has a screw bolt 21 which extends in the direction of displacement A of the bars 5. The screw bolt 21 can be screwed in a bearing member 22 and secured by means of the lock nut 23. The bearing member 22 is secured to the second bar half 5*b*. The screw bolt 21 also has a head 21*a* which engages into an opening 24 in a bar 25 which is connected to the first bar half 5*a* of the adjacent bar 5. The width b1 of the opening 24 is larger than the height h of the screw head 21*a* by the width b of the cutting gap. In that way, the head 21*a* is displaceable in the opening 24 by a distance which corresponds to the width b of the cutting gap. A compression spring 26 is also provided between the bearing member 22 and the bar 25.

Also provided at the two ends of the main frame structure 3 are hydraulic cylinders 27 which, by way of the drive shaft 28 and levers 29, act in the direction A on the outermost bars 5 which are disposed at both ends of the mounting frame structure 3.

The mode of operation of the cutting apparatus is as follows:

If small bricks with a format L1 of for example 24 cm are to be cut, then the actuating rods 16 are moved into their lower limit position by simultaneous actuation of the piston-cylinder units 15. Because of that movement, the arms 9 pivot downwardly and the projection 14 comes to lie between the two upper rollers 10*a* and 10*b*. The bar halves 5*a* and 5*b* take up the position shown in FIG. 2 in which there is only a small spacing a1 between the support plates 7 of the two bar halves 5*a* and 5*b* making up a bar 5. The two bar halves 5*a* and 5*b* of each bar are thus fixedly locked together. Between the support plates 7 of two adjacent bars there is a slot S whose width is only slightly wider than the diameter d of the cutting wire 6. The width of the slot S is set once upon assembly, more specifically by turning the screw bolt 21 in the bearing member 22. When the slot S is of the desired width of for example 2 mm, the screw bolt 21 is locked in that position by the lock nut 23. The slot S is held open at the desired width by the compression springs 26.

The porous concrete block 2 which is to be cut is then put down on to the support plates 7 and cut in the transverse direction by displacing the cutting frame in the direction B. When that is done, the cutting wires 6 each leave a cutting gap which is of a width B of about 1 mm, between the individual cut portions. After the porous concrete block 2 has been cut through in the transverse direction, the hydraulic cylinders 27 at the ends of the main frame structure 3 are actuated. When that occurs, they apply a pressure to the respective outermost bars 5. That causes the outermost bar to move towards the middle, whereby the springs 26 are compressed until the screw head 21*a* comes to bear against the oppositely disposed boundary surface of the opening 24. That causes the width of the slot S to be reduced by the width b of the cutting gap. As soon as the screw head 21*a* comes to bear against the right-hand boundary surface of the opening 24, the adjoining bar 5 is displaced in the same direction. As the bar half 5*a* is fixedly locked to the bar half 5*b*, the width of the next slot S is also reduced. However, the spacing a1 between the two support plates of the bar halves 5*a* and 5*b* which make up a bar 5 remains unaltered. In that way, all bars 5 are displaced towards the middle, from both ends of the main frame structure 3. The bar which is in the middle of the main frame structure 3 is advantageously locked. The fact that the bars are pushed towards each other means that the cutting gaps in the cut porous concrete block are closed. The individual portions of the cut block now lie closely one against the other so as to prevent the edges from crumbling away in a second cut which is perpendicular to the first. After the cut porous concrete block has been taken from the cutting table, the bars 5 are moved apart again in the opposite direction and then return to their original position as shown in FIGS. 2 and 5.

If bricks with a nominal dimension of 25 cm are to be cut, the actual dimension of which is actually to be 24.9375 cm, then the actuating rods 16 are moved into their upper limit position by operation of the piston-cylinder units 15, whereby the arms 9 are pivoted upwardly. Upon such upward pivotal movement, the roller 11*a* comes to bear against the projection 14 and pushes it towards the right, thereby increasing the spacing between the support plates 7 of the two bar halves 5*a* and 5*b* which together make up a bar 5, to the spacing a2, that being the situation shown in FIG. 6. However, the width of the slot S between the support plates 7 of two adjacent bars 5 remains unaltered. After the arms 9 have reached their upper limit position, the two bar halves 5*a* and 5*b* are again fixedly locked together. The cutting wires 6 must then be fitted to the cutting frame at the required spacing L2 of 24.9375 cm in known fashion, and then bricks of that format L2 can be cut. As the width of the slot S can be just as small as when cutting the smaller bricks of the format L1, in this operation also the porous concrete block enjoys optimum support and crumbling thereof is prevented. After the porous concrete block has been cut, the bars are pushed together and therewith also the individual portions of the porous concrete block, in the manner described above.

If now slabs or plates are to be cut from a porous concrete block, they are first cut to the required length with the apparatus according to the invention. If that length L3 does not by chance correspond to a multiple of the formats L1 and L2, it is then necessary for the two bar halves 5*a* and 5*b* of a bar which is disposed in the vicinity of the intended cut to be separated from each other. That is effected by the actuating rod 16 being moved into its middle position, whereby the arm 9 takes up the position shown in FIGS. 2 and 2*a*, by actuation of the piston-cylinder unit 15 which is associated with the respective bar 5. The bar half 5 can now be displaced towards the left, while the projection 14 which is connected to the bar half 5*b* can pass through between the two rollers 10*b* and 11*b*. The first bar half 5*a* together with the adjacent bar 5 which is coupled thereto by way of the spacer members 20 and all further bars which are to the left thereof are shifted towards the left until the slot S is in the region of the intended line of cut. In order to permit such movement of the bars 5 towards the left, a space is left free at the left-hand side of the main frame structure 3, as indicated by dash-dotted lines in FIG. 1.

So that the bar half 5*a* which is displaced towards the left remains at the required location, a clamping means 30 is provided on each bar half 5*a*, as can be seen from FIG. 3. Each clamping means 30 comprises two clamping jaws 31 which, upon actuation of the handle 32, can be clamped fast by means of the clamping screw 33 at any location on the clamping bar member 34. The clamping bar member 34 extends in the direction of movement A of the bars 5 and is fixedly connected to the main frame structure 3.

As soon as the bar half 5*a* at the location of the cut is fixedly clamped by means of the clamping device 30, a cutting wire 6 is also fitted in position at the location of the cut. As in this case also the width of the slot S is just as small as when cutting the formats L1 and L2, this arrangement also ensures that the porous concrete block 2 is securely supported in the cutting region, when cutting panels of a length L3, thereby preventing the block from crumbling away. It is irrelevant that the two bar halves 5*a* and 5*b* of the separated bar have moved apart by the distance a3 for cutting is not effected in the region between two bar halves 5*a* and 5*b*. If a porous concrete block is to be cut a plurality of times in the transverse direction, for the purposes of cutting shorter slabs or plates, it is then necessary for a respective plurality of bar halves which are disposed in the vicinity of the intended cut to be separated from each other in the above-indicated manner, moved towards the left, and clamped fast in the above-described fashion.

I claim:

1. In an apparatus for cutting a porous concrete block which is still in a plastic condition, having a horizontal cutting table comprising a plurality of bars which are arranged parallel and at a spacing from each other, for receiving the parallelepipedic porous concrete block which is lying on its wide side, and having a cutting frame which is movable relative to the cutting table in the longitudinal direction of the bars, with a plurality of cutting wires which extend in vertical planes and which are passed through the slots between the bars and by means of which the block can be cut up in a first horizontally extending direction of cut, wherein the bars are mounted horizontally displaceably perpendicularly to their longitudinal direction on a main frame structure and disposed between the bars are spacer members which restrict the relative movement of the bars away from and towards each other, to the width of the cutting gap, in such a way that the mutual spacing of the bars which are drawn apart from each other prior to the cutting operation can be reduced, after the cutting operation in the first direction of cut, by pushing the bars together, by the width of the cutting gap, comprising the improvement wherein each bar is divided in its longitudinal direction along a vertical plane and comprises two bar halves which are horizontally adjustable relative to each other perpendicularly to the longitudinal direction and the mutual spacing being adjustable by means of a respective adjusting device engaging each of the oppositely disposed ends of the bar halves, further that provided at each adjusting device is a coupling means which permits the two bar halves respectively belonging to a bar to be completely released, and that provided at one of the two bar halves is a clamping means with which said bar half can be fixedly clamped to a clamping bar member at any point thereon, said clamping bar member extending in the direction of displacement of the bars and being connected to the main frame structure.

2. Apparatus according to claim 1 wherein the width of the slot between two adjacent bars in the cutting position is only a little wider than the diameter of the cutting wire.

3. Apparatus according to claim 1 wherein the adjusting device has an arm which is pivotable on the first bar half about a pivot axis extending in the longitudinal direction thereof and which carries two pairs of rollers arranged at different spacings from the pivot axis at a spacing above each other, the axes of rotation respectively of said rollers extending parallel to the pivot axis, and that provided on the second bar half (**5*b***) is a cylindrical projection which extends into the region of movement of the rollers and whose diameter corresponds to the inside spacing between the two rollers belonging to a respective pair.

4. Apparatus according to claim 3 wherein the inside spacing between the two rollers disposed at the free end of the arm is greater than the diameter of the projection.

5. Apparatus according to claim 3 wherein a 3-position hydraulic piston-cylinder unit with two limit positions and a predetermined middle position is provided for actuating the arm.

6. Apparatus according to claim 3 wherein the pivotal movement of the arm disposed at the one end of the bar half can be transmitted by way of an adjusting shaft extending parallel to said bar half, to the arm of an adjusting device of similar kind which is provided at the other end of the bar half.

7. Apparatus according to claim 1 wherein each spacer member comprises a screw bolt which extends in the direction of displacement of the bars and which has a head displaceable in an opening in a bar member connected to the first bar half, over a distance corresponding to the width of the cutting gap, that the screw bolt can be screwed into a bearing member connected to the second bar half of the adjacent bar and that a compression spring is provided between the bearing member and the bar member.

* * * * *